US005680709A

United States Patent [19]

Stone

[11] Patent Number: 5,680,709

[45] Date of Patent: Oct. 28, 1997

[54] ALIGNMENT DEVICE

[76] Inventor: John W. Stone, 7959 S. Vincennes Way, Englewood, Colo. 80112

[21] Appl. No.: 398,524

[22] Filed: Mar. 6, 1995

[51] Int. Cl.[6] ..... G09F 7/00

[52] U.S. Cl. ..... 33/613; 33/645; 33/562; 33/565; 40/600

[58] Field of Search ..... 33/1 B, 1 G, 286, 33/474, 613, 614, 615, 616, 617, 618, 619, 620, 621, 622, 623, 645, 562, 563, 565, DIG. 1, 758, 549, 573; 40/600, 642

[56] References Cited

U.S. PATENT DOCUMENTS

| | | | |
|---|---|---|---|
| 2,361,670 | 10/1944 | Whitehead | 40/642 |
| 2,932,897 | 4/1960 | Huber | 33/758 |
| 3,698,111 | 10/1972 | Smith | 40/642 |
| 4,236,311 | 12/1980 | Mattson | 40/640 |
| 4,896,428 | 1/1990 | Peterson | 33/615 |
| 5,077,925 | 1/1992 | Herrera et al. | 40/642 |

*Primary Examiner*—G. Bradley Bennett
*Attorney, Agent, or Firm*—Timothy J. Martin; Michael R. Henson

[57] ABSTRACT

A device for properly aligning and registering a display panel onto an adhesive backing panel to create a display article is provided, as well as a method and kit for such registration. The alignment device comprises a base having two wall portions which define an area within the base that is geometrically congruent to the display and backing panels. The wall portions are skewed with respect to one another, defining limit stops against which the display and backing panels can be placed to inhibit their movement and enable proper registration. The alignment device is preferably made out of a unitary construction of plastic, with the base having an arcuate cut-out along its perimeter. A method for registering the display panel on the backing to create a display article provides for proper placement of the panels into the alignment device. A kit includes a plurality of backing panels with adhesive layers, and an alignment device. Backing panels may include a removable protective sheet on the adhesive layer and a magnetic strip.

15 Claims, 2 Drawing Sheets

ALIGNMENT DEVICE

FIELD OF THE INVENTION

The present invention relates to a device adapted to properly align and register a display panel onto a backing panel. More particularly, the present invention relates to an alignment device adapted to properly register a display panel, such as business card or photograph, onto an adhesive, geometrically congruent backing panel to create a display article.

BACKGROUND OF THE INVENTION

It is common in many households to see a variety of photographs, messages, memos, coupons and advertisements affixed to the sides and doors of the refrigerator, where individuals can conveniently locate or view such items in the course of their everyday tasks. Often, photographs, information, or messages are displayed on a refrigerator or other metallic surface using common cellophane tape, which provides little adhesive value for heavier objects and which often loses its "stickiness" after only a short period of time, causing the items to fall from the display surface. In addition, the cellophane tape detracts from the display of a photograph or other item, as, most often, a number of strips of the tape are required to affix the article to a vertical surface.

Similarly, it is known to use decorative magnets on refrigerators and other metallic surfaces to display photographs and other articles. Again, however, such magnets are often unable to hold heavier objects and tend to create a cluttered appearance. Photographs and other items wished to be displayed on metallic surfaces are often placed in plexiglass or plastic frame devices provided with a magnet; again, these structures offer no substantial adhesion so that the articles contained within the frame often slip out through its open edges.

For advertising or other informational purposes, it is known in the art to use magnetic strips onto which printed material or pictures may be affixed. These magnets are often distributed by business owners or professionals to their customers or clients so that the customer will place the magnet in a location that will constantly remind the customer to use the services printed on the magnet should such a need arise. However, these magnetic advertisements must be ordered from and made by stationers or print shops in large quantities, often at a cost prohibitive for many business people and in amounts that might never be used.

To avoid such an expense, some professionals, such as real estate agents and lawyers, attempt to produce "do-it-yourself" display articles to advertise their services. Here, business cards may be glued to a magnetic backing panel, one at a time or in small quantities, as they are needed. However, it is often difficult and time consuming to mount these cards, photographs, or other articles to a magnetic backing panel of the same geometric configuration in a neat, attractive manner so that customers will want to prominently display them. In addition, it may be difficult to locate magnets of various geometric designs to accommodate unusually sized and shaped cards or photographs.

Therefore, a need exists for an inexpensive, yet durable device and a convenient method useful in mounting a business card, photograph, or other types of information displays of various geometric configurations onto a congruently-shaped sized adhesive magnetic backing panel so that the mounted article is perfectly aligned with the underlying magnetic backing panel and presents an attractive item suitable for display purposes. Such a device is also needed in a kit form for the do-it-yourself market. It is from these considerations and others that the present invention evolved.

SUMMARY OF THE INVENTION

It is an object of the present invention to provide a new and useful alignment device, method and kit used for registering a display panel onto a backing panel of selected congruent geometric configurations to create a display articles.

Another object of the present invention is to provide such an alignment device that is durable yet inexpensive to both manufacture and purchase.

Yet another object of the present invention is to provide such an alignment device and method which allows the user to avoid the problems commonly associated with accurate registration of display and backing panels so that a display article of attractive appearance is created.

Another object of the present invention is to provide such an alignment device that can register a display panel onto a magnetic backing panel that is provided with an adhesive surface so that the resulting display article can be conveniently displayed for viewing on metallic surfaces, such as refrigerators, computers, telephones and the like.

Still a further object of the present invention is to provide a method and a kit for registering a display panel onto an adhesive backing panel of selected geometric configurations in such a way that an attractive display device is created that is suitable for display of business cards, advertisements, nameplates, photographs and the like.

Generally, an alignment device is adapted to register a display panel having an outer perimeter of a selected geometric configuration onto a geometrically congruent backing panel so that the display panel can be properly and neatly registered onto the backing panel to create a display article. In its broad form, the alignment device includes a base adapted to be placed on a support surface. Extending upwardly from the base along a peripheral margin are at least two upstanding wall portions oriented along a boundary of an imaginary area within the base that is geometrically congruent with the display panel and the backing panel. These wall portions are skewed with respect to one another to define limit stops against which the display panel and the backing panel may be abutted so that their movement is prevented in at least two degrees of motion. By being prevented from such movement, proper alignment and registration of the display panel onto the backing panel is allowed.

In a preferred form of the alignment device, the base and wall portions are formed in an integral one piece construction of plastic. The two wall portions intersect to form a vertex portion adapted to receive the vertices of both the display panel and backing panel. The vertex portion may include a rounded recess that faces toward the imaginary area within the base. The base may include an arcuate cut-out along its perimeter that is adapted to enable the user to grip both the display panel and the backing panel and assist in the removal of the created display article from the alignment device.

To accommodate more specifically the display of business cards and similarly shaped articles, one embodiment of the alignment device is adapted to register a display panel having an outer rectangular perimeter onto a rectangular backing panel to create a display item. Such an alignment device is comprised of a rectangular base for placement on a support surface. The base has first and second longitudinal edges and first and second lateral edges. Each of the longitudinal edges has an arcuate cut-out which assists the user in removing the display panel, backing panel and resulting display article from the alignment device.

Upstanding wall portions are oriented substantially along each of the longitudinal edges and along each of the lateral edges of the base to define a region that can matably receive a backing panel. These wall portions intersect at each corner of the rectangular base to form vertex portions, each of which is adapted to matably receive vertices of each of the display panel and the backing panel. Each vertex portion formed by the wall portions includes a rounded recess facing the defined region within the base. The combination of the wall portions and vertex portions define limit stops against which the display panel and backing panel may be simultaneously placed so that movement is prevent, enabling proper registration and alignment of the display panel onto the backing panel. It is preferred that the base and wall portions be formed of an integral one piece construction of plastic.

A method for registering a display panel having an outer perimeter of selected geometric configuration onto a geometrically congruent backing panel with an adhesive layer to create a display article comprises several steps. The first of such steps requires placing the backing panel into an alignment device with the adhesive layer exposed. The alignment device has a base and wall portions that together provide a limit stop for an edge of the backing panel to prevent it from moving. A second step in such registration method requires placing an edge of the display panel on a congruent portion of the backing panel so that the display panel is then oriented at an angle greater than zero degrees from the plane of the base. This action aligns the portion of the display panel against the limit stop. In a third step, the display panel is advanced into contact with the adhesive layer of the backing panel while simultaneously maintaining registry of the display panel's edge against the limit stop.

In a preferred form of this method, the display panel may be a business card, photograph, advertising or information displays, or personal message papers. A magnetic strip may be included on the backing panel on a surface opposite of the adhesive layer.

A kit provided by the present invention is adapted to allow a user to create a plurality of displays from display panels having a common geometric shape. Comprising such a kit is a plurality of backing panels in a shape congruent to a selected geometric shape and having an adhesive layer, and an alignment device with a base and upstanding wall portions extending upwardly from the base to define an imaginary area of the selected geometric shape. In the preferred embodiment of this kit, the backing panel may include a removable sheet covering its adhesive layer that is peeled away before a display is affixed to it. The backing panel may also have a magnetic strip located on a surface opposite of the adhesive layer.

These and other objects of the present invention will become more readily appreciated and understood from a consideration of the following detailed description of the preferred embodiment when taken together with the accompany drawings, in which:

DETAILED DESCRIPTION OF THE EXEMPLARY EMBODIMENTS

The present invention broadly concerns apparatus and methods for securing a display panel onto a backing panel in order to produce a finished product in the form of an article to be displayed. Specifically, the present invention is designed to help a user affix a display panel onto a flexible magnetic backing by means of an adhesive layer placed on the backing panel in a manner such that the display panel and the backing panel are registered for alignment with one another. In the exemplary embodiment, the alignment device and method is described with respect to the registration of a business card onto a magnetized backing, but it is to be understood that the apparatus and method according to the present invention should not be limited to this single embodiment. Indeed, it is contemplated that a variety of display panels may be mounted to different backings with these display panels including such things as photographs, information displays, advertising displays and personal message papers along with the business cards described herein. Moreover, although it is contemplated that the present invention will be most useful with backing panels and display panels which are rectangular in shape, it should be appreciated that the concepts of the present invention can be used to help align any two geometrically congruent display and backing panels.

Figure 1:
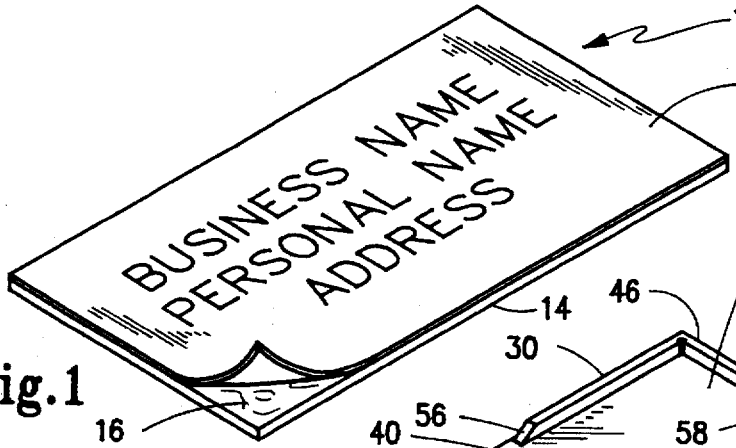
FIG. 1 is a perspective view showing a completed display article produced using the apparatus and method according to the present invention.

With reference to FIG. 1, then, it may be seen that a finished product in the form of a display article 10 includes a display panel 12 which is rectangular in geometric shape. Preferably, display panel 12 is a business card having information such as the business name, the personal name and address of a person promoting his/her products or services by means of the business card. In any event, display panel 12 is affixed to a magnetized backing panel 14, preferably by means of an adhesive layer 16. Backing panel 14 is also rectangular and is congruent with display panel 12. Thus, display article 10 can be magnetically secured to any suitable support, such as a refrigerator, stove, etc., and may be used to hold notes or other papers. It should be understood, however, that backing panels other than magnetic backing panel 14 may be employed.

While it is known in the prior art to secure a display panel, such as a business card or photograph, onto a backing panel, such as the magnetic backing panel 14, many users have found it difficult to obtain proper registration of the display panel onto the backing panel. Any lack of registration, of course, substantially distracts from the appearance of the finished display article so that typical users often have a high scrap rate, especially when trying to affix business cards or photographs to the adhesive layer on the magnetic backing. Accordingly, there is a need for a simple, inexpensive alignment device to help with this registration process.

Figure 2:
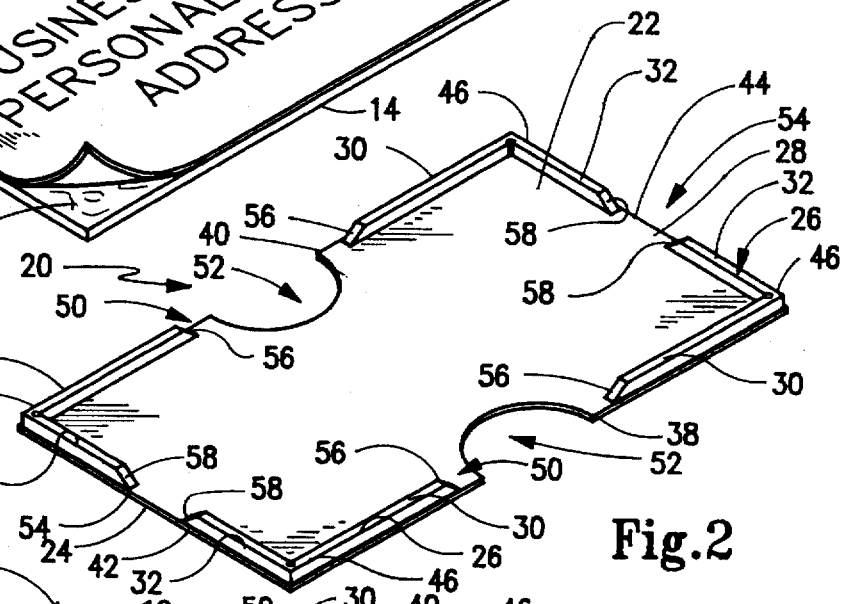
FIG. 2 is a perspective view of the alignment device according to the exemplary embodiment of the present invention.

With reference to FIG. 2, then, the alignment device 20 according to the preferred embodiment of the present invention is shown. Alignment device 20 has a flat base 22 which is adapted to be placed on the support surface. Base 22 has a surrounding peripheral edge 24, and an upstanding wall 26 extends around a majority of the portion of the peripheral edge 24 and is located in peripheral margin 28 that is adjacent to peripheral edge 24. In FIG. 2, it may be seen that upstanding wall 26 is formed by longitudinal wall portions 30 and lateral wall portions 32. Accordingly, upstanding wall 26 bounds an imaginary area on base 22 that is geometrically congruent with the selected shape of the display panel and the backing panel for which alignment device 20 is designed for use. In this exemplary embodiment, the display panel 12 and the backing panel 14 are rectangular. Accordingly, opposed ones of the longitudinal wall portions 30 are parallel to one another as are opposed ones of lateral wall portions 32. Moreover, a pair of longitudinal wall portions 30 are aligned with one another along each longitudinal side edge 38 and 40. Correspondingly, a pair of lateral wall portions 32 are aligned with one another and are respectively located along lateral side edges 42 and 44 of base 22.

With reference again to FIG. 2, it may be seen that each longitudinal wall portion 30 is joined at a right angle to a respective lateral wall portion 32 in order to form a corner or vertex wall portion 46. Accordingly, each wall portion 30, 32 which form a respective vertex wall portion 46 are skewed relative to one another. In the exemplary embodiment, of course, these wall portions are skewed at a 90° angle with respect to one another. In any event, the respective wall portions 30, 32 form limit stops against which edges of the display panel 12 and the backing panel 14 may be simultaneously placed such that movement in at least two degrees of motion is prevented.

Figure 3:
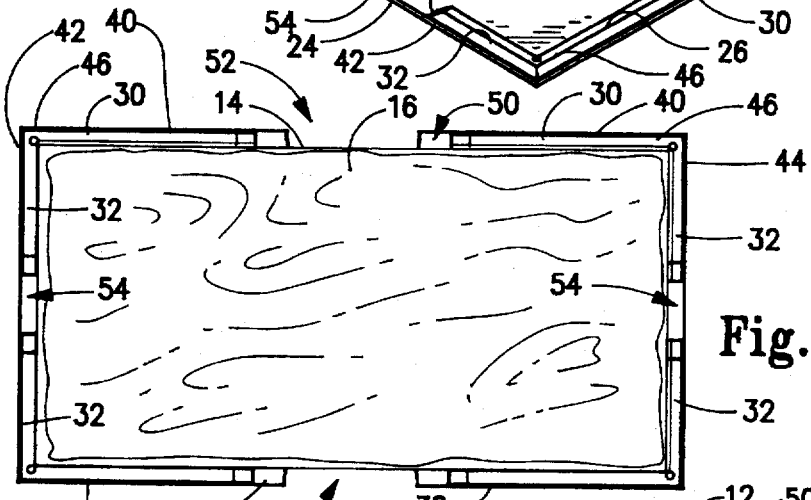
FIG. 3 is a top plan view of the alignment device shown in FIG. 2 receiving a backing panel therein.
Figure 4:
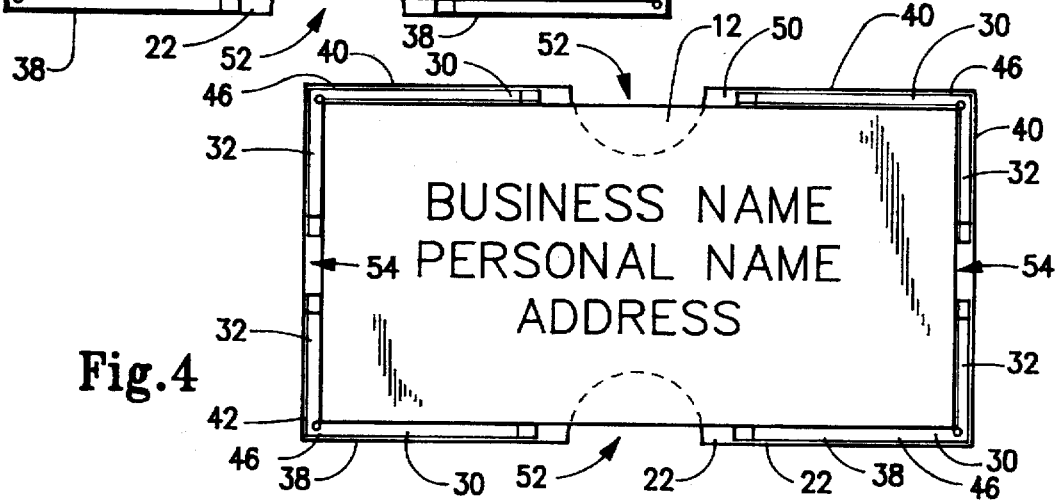
FIG. 4 is a top plan view of the alignment device of FIGS. 2 and 3 showing a display panel received in the alignment device on the backing panel.
Figure 5:
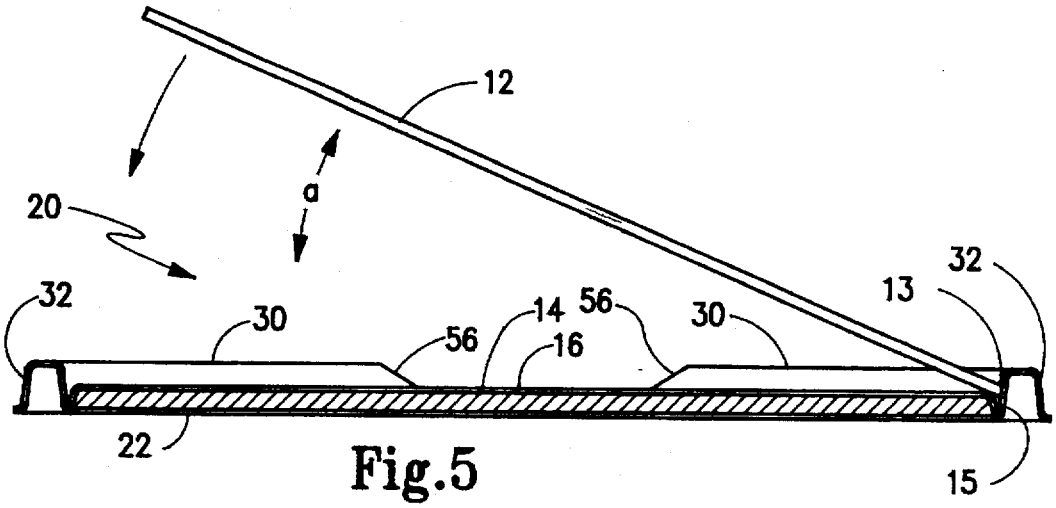
FIG. 5 is a side view in cross-section showing the use of the alignment device of FIGS. 2–4 in registering a display panel onto a backing panel.

Thus, as is shown in FIG. 3, it may be seen that backing panel 14 along with its attached adhesive layer 16 may be first placed in the area of base 22 bounded by upstanding wall 26 after which the display panel 12 is placed in registration therewith, as is shown in FIG. 4. Moreover, as can be seen in these FIGS. 2–4, each of the aligned ones of longitudinal wall portions 30 are separated by a medial space 50, and an arcuate cut-out 52 is formed in base 22 to allow access for the thumb and fingers of the user in order to grip the display panel and backing after affixed to one another into the display article 10. Likewise, each of the aligned ones of lateral wall portions 32 are separated by a medial space 54, although no corresponding cut-out potion is provided in base 22. Finally, it may be seen in reference to FIG. 2, that the facing ends of each of the aligned ones of wall portions 30 and the aligned ones of wall portions 32 are formed by a ramp 56, 58 respectively that is oriented at an acute angle with respect to base 22. This angle may be approximately 45°. With reference now to FIG. 5, it may be seen that alignment device 20 is quite useful in securing a display panel 12 to a backing panel 14. In FIG. 5, it may be seen that the method according to the present invention includes the placing of the backing panel 14 into alignment device 20 so that the backing panel is prevented from moving. Next, an edge of the display panel, such as lateral edge 13 of display panel 12, that is geometrically congruent is placed on a geometrically congruent portion of said backing panel, such as lateral edge 15 of backing panel 14 with the display panel being oriented in a plan that is at an angle greater than 0° from the plan of flat base 22, such as angle "a". Thereafter, display panel 12 is advanced into contact with the adhesive layer 16 of backing panel 14 while maintaining registry with the edge of the display panel with the edge of the backing panel against the limit stop. Preferably this method includes the supporting of the peripheral edge of the backing panel and the display panel during advancement in at least two directions to prevent slippage.

Figure 6:
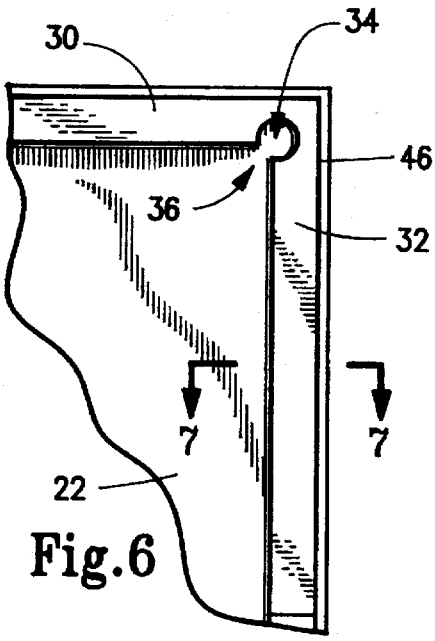
FIG. 6 is an enlarged top view of a corner portion of the display panel of FIGS. 2–5.
Figure 7:
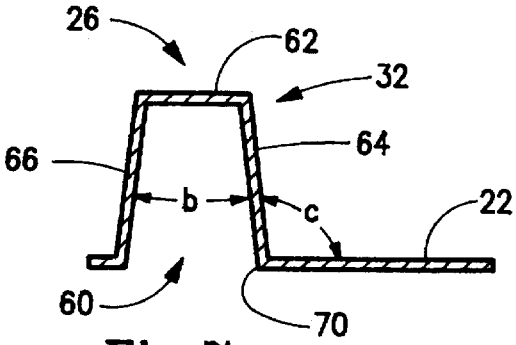
FIG. 7 is a cross-sectional view taken about lines 7—7 of FIG. 6.

With reference now to the greater detail provided by FIGS. 6 and 7, it may be seen that it is preferred that base 22 and wall portions 30 and 32 be formed as an integral one-piece construction of plastic. Further, as is seen in FIG. 6, it may be seen that each vertex wall portion 46 formed by the combination of a respective longitudinal wall portion 30 and lateral wall portion 32 includes a rounded recess 34 which has an opening 36 which faces the interior area bounded by upstanding wall 26. This recess 34 allows the accommodation of any unevenness at the vertices of each of the display panel and backing panel. Further, as is shown in FIG. 7, it is preferred that upstanding wall 26, such as exemplified by the lateral wall portion 32 shown in this Figure, is formed as an inverted, U-shaped channel 60 having a top wall 62, an inner side wall 64 and an outer side wall 66. Side walls 64 and 66 are upwardly convergent toward one another and base at a small acute angle "b". Inner side wall 64 is therefore at a small obtuse angle "c" of about 100°–110° with respect to base 22. This structure both saves on material and cost as well as provides an aid in aligning display panel 12 onto backing panel 14 since the area bounded by upstanding wall 26 is slightly larger proximate to top wall 62 than the area bounded by the corner 70 formed by inner side wall 64 and base 22.

Figure 8:
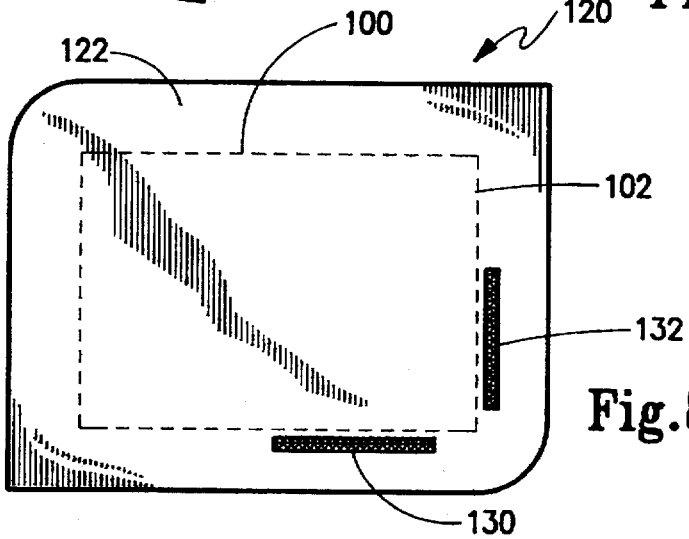
FIG. 8 is a diagrammatic view showing the generalized structure of the alignment device according to the present invention.

With reference to FIG. 8, it may be seen that a generalized embodiment of the present invention includes some base 122 that is adapted to be placed on a support surface. Upstanding wall portions 130 and 132 extend upwardly from base 122 and oriented along a boundary 102 of an imaginary area 100 that is geometrically congruent with the display panel and the backing panel with which the alignment device 120 is designed to work. Wall portions 130, 132 are skewed with respect to one another to define at least two limit stops against which the display panel and the backing panel may be simultaneously placed to restrict movement in at least two degrees of motion by the display panel and the backing panel. This, then, enables proper registration of the display panel onto the backing panel. However, as noted above, it is preferred that the wall portions extend substantially around the imaginary area 100 for best operation.

Figure 9:
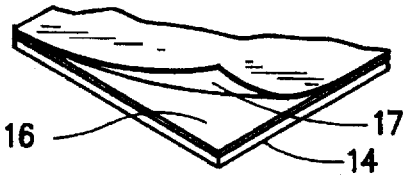
FIG. 9 is a perspective view of a corner of a backing panel of the type preferred for use in the method and kit of the present invention.

From the foregoing, it should be appreciated that the alignment device of the present invention can be used with a variety of display panels including such things as business cards, photographs, information displays, advertising display and personal message papers, to name a few. Furthermore, since it is desired that the present alignment device be used by a "do-it-yourself" user, it is contemplated that the present invention may be marketed in a kit form. Here, such a kit would include an alignment, such as alignment device 120 along with a plurality of base panels pre-cut to the selected geometric size defined by upstanding wall 26. This, for example, could be the size of a standard business card, a standard school picture or other standard size as desired. Each of the plurality of backing panels would have an adhesive layer, such as adhesive layer 16, protected by a peel-away protective sheet, such as sheet 17 shown in FIG. 9. Preferably, each of the backing panels would be a flexible magnetic panel having the adhesive and protective sheet so that a user would simply select one of the panels and place it in the alignment device after removing the protective sheet removed. Then, the user would advance the selected display panel, such as the business card or school picture onto the backing panel in a neatly registered manner.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. An alignment device adapted to register a display panel having an outer perimeter of a selected geometric configuration onto geometrically congruent backing panel that has an adhesive layer so that said display can be properly affixed thereon to create a display article comprising:

(a) a base adapted to be placed on a support surface;

(b) two upstanding wall portions disposed on and extending upwardly from said base and oriented along a boundary of an imaginary area within said base that is geometrically congruent with said display panel and said backing panel, said wall portions skewed with respect to one another to define limit stops against which said display panel and said backing panel are adapted to be simultaneously placed such that movement in at least two degrees of motion by said display panel and backing panel is prevented thereby enabling proper registration of said display panel onto said backing panel; and (c) said base having an arcuate cut-out along its perimeter with the cut-out extending from the perimeter to a location within the imaginary area.

2. An alignment device according to claim 1 wherein said base and wall portions are formed in an integral one piece construction of plastic.

3. An alignment device according to claim 2 wherein said two wall portions intersect thereby forming a vertex portion adapted to receive vertices of each of said display panel and backing panel.

4. An alignment device according to claim 3 wherein said vertex includes a rounded recess that faces the imaginary area.

5. An alignment device according to claim 2 wherein the base includes a pair of oppositely disposed arcuate cut-outs along its perimeter, said cut-outs adapted to enable a user to grip said display panel and said backing panel, thereby assisting the user to remove the display article created thereby.

6. An alignment device adapted to register a display panel having an outer rectangular perimeter onto a congruent rectangular backing panel that has an adhesive layer so that said display panel can be properly registered thereon to form a display item, comprising:

(a) a rectangular base adapted to be placed on a support surface, said base having first and second longitudinal edges and first and second lateral edges; and (b) an upstanding wall formed by wall portions oriented along each of said first and second longitudinal edges and along each of said first and second lateral edges to define a region sized and adapted to receive said display panel and said backing panel, said wall portions intersecting at each corner of said rectangular base thereby forming vertex portions, each of which is adapted to matably receive vertices of each of said display panel and backing panel, each of said wall portions including an inner side wall oriented at an obtuse angle with respect to said base, the combination of said wall portions and said vertex portions defining limit stops against which said display panel and said backing panel are adapted to be simultaneously placed such that movement is prevented, thereby enabling proper registration of said display panel onto said backing panel.

7. An alignment device according to claim 6 wherein said base and wall portions are formed in an integral one piece construction of plastic.

8. An alignment device according to claim 6 wherein each of said longitudinal edges has a centrally located arcuate cut-out which enables a user to grip said display panel and said backing panel, thereby assisting the user to remove said backing panel and said display panel when in a registered state from said alignment device.

9. An alignment device according to claim 6 each of said vertex portion includes a rounded recess facing said region.

10. A kit adapted to allow a user to create a plurality of displays out of display panels having a common selected geometric shape, comprising:

(a) a plurality of backing panels, each of said backing panels having a geometrical shape congruent to the selected geometric shape and having a surface provided with an adhesive layer; and (b) a reusable alignment device including a base and upstanding wall portions extending upwardly therefrom and defining an imaginary area congruent to said selected geometric shape, said alignment device operative to permit repeated introduction of a selected pair comprising a display panel and a backing panel and removal of the selected pair after joinder thereof by said adhesive layer.

11. A kit according to claim 10 wherein each said backing panel includes a removable protective sheet on said adhesive layer whereby said protective sheet may be removed prior to attachment of said display panel to said backing panel.

12. A kit according to claim 10 wherein said backing panels defined by a magnetic strip.

13. A method for registering a display panel having an outer perimeter of selected geometric configuration onto a geometrically congruent backing panel having an adhesive layer so that said display panel can be affixed thereto to create a display article, comprising the steps of:

(a) placing said backing panel into an alignment device with the adhesive layer exposed, said alignment device having a base and wall portions, whereby the combination of said base and said wall portions provide at least two limit stops for edges of said backing panel so that the backing panel is prevented from moving in two degrees of motion;

(b) placing an edge of said display panel upon a geometrically congruent portion of said backing panel so that said display panel is oriented at an angle greater than zero degrees from a plane defined by said base, thereby aligning the portion of said display panel against said limit stops;

(c) advancing said display panel into contact with the adhesive layer of said backing panel while maintaining registry of the edge of said display panel with the edge of said backing panel against said limit stops to create a joined pair;

(d) removing the joined pair from the alignment device; and (e) repeating steps (a)–(d) to produce a plurality of joined pairs of display panels and backing panels.

14. A method according to claim 13 wherein said display panel is selected from a group consisting of business cards, photographs, information displays, advertising displays, and personal message papers.

15. A method according to claim 13 wherein said backing panel is provided with a magnetic strip.

* * * * *